US006823311B2

(12) United States Patent
Tetsumoto

(10) Patent No.: US 6,823,311 B2
(45) Date of Patent: Nov. 23, 2004

(54) DATA PROCESSING SYSTEM FOR VOCALIZING WEB CONTENT

(75) Inventor: Hideo Tetsumoto, Aichi (JP)

(73) Assignee: Fujitsu Limited, Kawasaki (JP)

( * ) Notice: Subject to any disclaimer, the term of this patent is extended or adjusted under 35 U.S.C. 154(b) by 676 days.

(21) Appl. No.: 09/778,916

(22) Filed: Feb. 8, 2001

(65) Prior Publication Data

US 2002/0002461 A1 Jan. 3, 2002

(30) Foreign Application Priority Data

Jun. 29, 2000 (JP) ..... 2000-195847

(51) Int. Cl.[7] ..... G10L 13/06
(52) U.S. Cl. ..... 704/270.1; 704/260
(58) Field of Search ..... 704/235, 260, 704/270, 270.1, 257

(56) References Cited

U.S. PATENT DOCUMENTS

| | | | | |
|---|---|---|---|---|
| 5,555,343 A | | 9/1996 | Luther | 395/269 |
| 5,634,084 A | | 5/1997 | Malsheen et al. | 395/2.69 |
| 5,699,486 A | * | 12/1997 | Tullis et al. | 704/270.1 |
| 5,884,266 A | | 3/1999 | Dvorak | 704/275 |
| 5,890,123 A | * | 3/1999 | Brown et al. | 704/270.1 |
| 6,115,686 A | * | 9/2000 | Chung et al. | 704/260 |

FOREIGN PATENT DOCUMENTS

| | | |
|---|---|---|
| EP | 11272442 | 10/1999 |
| JP | 06217740 A | 8/1994 |
| JP | 10164249 A | 6/1998 |
| WO | WO 97/40611 | 10/1997 |
| WO | WO 9966496 | 12/1999 |

* cited by examiner

*Primary Examiner*—Richemond Dorvil
*Assistant Examiner*—Abul K. Azad
(74) *Attorney, Agent, or Firm*—Staas & Halsey LLP

(57) ABSTRACT

A data processing system which vocalizes text information on a web page, applying an appropriate modification to the original text, depending on the genre of that web page content. A call reception unit accepts a call signal from a user's telephone set. A speech recognition unit recognizes the user's verbal message received from the telephone set. When a request for a particular web page is recognized by the speech recognition unit, a web page data collector makes access to the requested web page to obtain its web page data. A keyword extractor then extracts a predetermined keyword from the obtained web page data. A replacement unit locates a character string that is associated with the extracted keyword, and modifies the text of the web page data by replacing the located character string with another character string. Finally, a vocalizer performs a text-to-speech conversion for at least a part of the resultant text which has been modified by the replacement unit.

10 Claims, 12 Drawing Sheets

| ORIGINAL TERM | ALTERNATIVE TERM | KEYWORD #1 | KEYWORD #2 | KEYWORD #3 | KEYWORD #4 |
|---|---|---|---|---|---|
| — | VERSUS | SPORTS | SOCCER | BASEBALL | RUGBY |
| F1 | FORMULA ONE | MOTOR SPORTS | RALLY | | |
| GP | GRAND PRIX | MOTOR SPORTS | RALLY | | |

FIG. 7

| Code | Brand | Opening | High | Low |
|---|---|---|---|---|
| 4062 | AAA Metal | 1985 | 2020 | 1928 |
| 6479 | BBB Electric | 1299 | 1309 | 1290 |
| 6501 | CCC Mfg | 1351 | 1363 | 1335 |

```
<body>
<table border="1" width="100%">

  <tr>
    <th width="20%">Code</th>
    <th width="20%">Brand</th>
    <th width="20%">Opening</th>
    <th width="20%">High</th>
    <th width="20%">Low</th>
  </tr>
  <tr>
    <td width="20%" align="center"> 4062</td>
    <td width="20%" align="center"> AAA Metal</td>
    <td width="20%" align="center"> 1985</td>
    <td width="20%" align="center"> 2020</td>
    <td width="20%" align="center"> 1928</td>
  </tr>
  <tr>
    <td width="20%" align="center"> 6479</td>
    <td width="20%" align="center"> BBB Electric</td>
    <td width="20%" align="center"> 1299</td>
    <td width="20%" align="center"> 1309</td>
    <td width="20%" align="center"> 1290</td>
  </tr>
  <tr>
    <td width="20%" align="center"> 6501</td>
    <td width="20%">
      <p align="center"> CCC Mfg</td>
    <td width="20%" align="center"> 1351</td>
    <td width="20%" align="center"> 1363</td>
    <td width="20%" align="center"> 1355</td>
  </tr>

</table>
</body>
```

FIG. 12

DATA PROCESSING SYSTEM FOR VOCALIZING WEB CONTENT

BACKGROUND OF THE INVENTION

1. Field of the Invention

The present invention relates to a data processing system, and more particularly to a data processing system which provides the user with vocalized information of web pages that are written in a markup language.

2. Description of the Related Art

Today's expanding Internet infrastructure and increasing amounts of web content have enabled us to utilize various information resources available on the networks. While it is definitely useful, the Internet is not equally accessible to everyone. One of the obstacles to Internet access is that people must be able to afford to buy a personal computer and subscribe to an Internet connection service. Another obstacle may be that it requires some knowledge about how to operate a personal computer. Such computer literacy, however, is not in the possession of everybody. Particularly, most resources on the Internet are intended for browsing on a monitor and not designed for people who have a visual impairment or weak eyesight. For those handicapped people, the Internet is not necessarily a practical information source.

To solve the above problems with Internet access, the Japanese Patent Laid-open Publication No. 10-164249 (1998) proposes a system which vocalizes web page content by using speech synthesis techniques for delivery to the user over a telephone network. However, a simple text-to-speech conversion is often insufficient for the visually-impaired users to understand the content of a web page document.

SUMMARY OF THE INVENTION

Taking the above into consideration, an object of the present invention is to provide a data processing system which converts information on the Internet into a more comprehensible vocal format.

To accomplish the above object, according to the present invention, there is provided a data processing system which supplies a user with vocalized information of web pages that are written in a markup language. This data processing system comprises the following elements: a call reception unit which accepts a call from the user's telephone set; a speech recognition unit which recognizes verbal message being received from the user's telephone set; a web page data collector which makes access to a particular web page to obtain web page data therefrom, when a request for that web page is recognized by the speech recognition unit; a keyword extractor which extracts a predetermined keyword from the web page data; a replacement unit which locates a character string associated with the keyword extracted by the keyword extractor, and modifies the text of the web page data by replacing the located character string with another character string; and a vocalizer which vocalizes at least a part of the resultant text that has been modified by the replacement unit.

Further, to accomplish the above object, there is provided another a data processing system which supplies a user with vocalized information of web pages that are written in a markup language. This data processing system comprises the following elements: a call reception unit which accepts a call from the user's telephone set; a speech recognition unit which recognizes verbal message being received from the user's telephone set; a web page data collector makes access to a particular web page to obtain web page data therefrom, when a request for that web page is recognized by the speech recognition unit; a keyword extractor which extracts a predetermined keyword from the web page data; an addition unit which locates a character string associated with the keyword extracted by the keyword extractor, and modifies the text of the web page data by inserting an additional character string to the located character string; and a vocalizer which vocalizes at least a part of the resultant text that has been modified by the addition unit.

Moreover, to accomplish the above object, there is provided yet another a data processing system which supplies a user with vocalized information of web pages that are written in a markup language. This data processing system comprises the following elements: a call reception unit which accepts a call from the user's telephone set; a speech recognition unit which recognizes verbal message being received from the user's telephone set; a web page data collector makes access to a particular web page to obtain web page data therefrom, when a request for that web page is recognized by the speech recognition unit; a character string extractor which extracts, from the obtained web page data, a group of character strings that have a semantical relationship; and a vocalizer which vocalizes the group of character strings extracted by the character string extractor.

The above and other objects, features and advantages of the present invention will become apparent from the following description when taken in conjunction with the accompanying drawings which illustrate preferred embodiments of the present invention by way of example.

BRIEF DESCRIPTION OF THE DRAWINGS

FIG. 7 shows an example of a character string translation table;

FIG. 12 shows an example HTML document corresponding to the web page shown in FIG. 10.

DESCRIPTION OF THE PREFERRED EMBODIMENTS

Preferred embodiments of the present invention will be described below with reference to the accompanying drawings.

Figure 1:
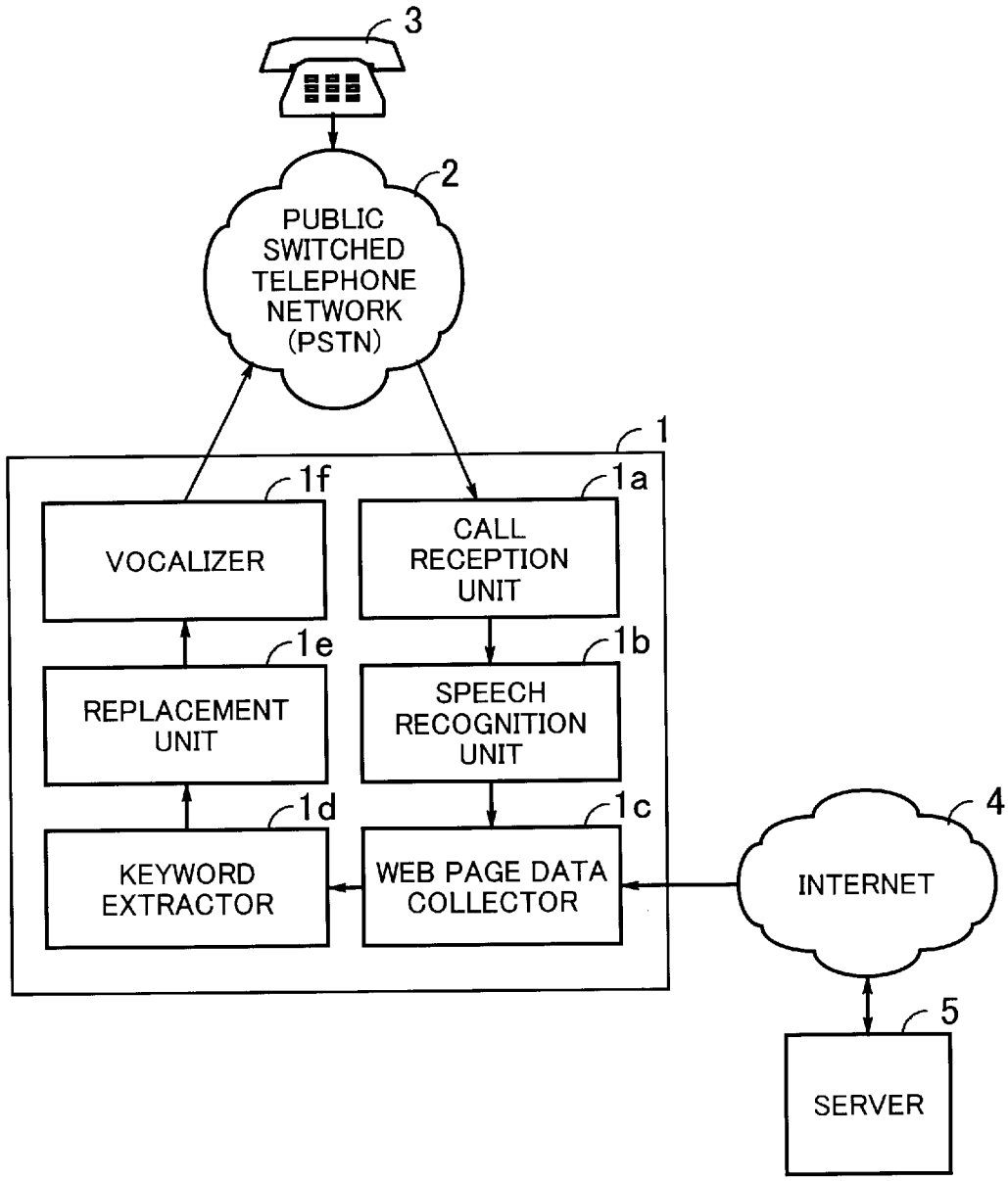
FIG. 1 is a conceptual view of the present invention.

FIG. 1 is a conceptual view of a data processing system according to the present invention. This data processing system 1 is connected to a telephone set 3 through a public switched telephone network (PSTN) 2, which allows them to exchange voice signals. The telephone set 3 converts the user's speech into an electrical signal and sends it to the data processing system 1 over the PSTN 2. The Internet 4 serves as a data transmission medium between the data processing system 1 and server 5, transporting text, images, voice, and other information. The server 5 is one of the world wide web servers on the Internet 4. When requested, the server 5 provides the data processing system 1 with its stored web page data written in a markup language such as the Hypertext Markup Language (HTML).

The data processing system 1 comprises a call reception unit 1*a*, a speech recognition unit 1*b*, a web page data collector 1*c*, a keyword extractor 1*d*, and a replacement unit 1*e*, and a vocalizer 1*f*. These elements provide information processing functions as follows.

The call reception unit 1*a* accepts a call initiated by the user of a telephone set 3. The speech recognition unit 1*b* recognizes the user's verbal messages received from the telephone set 3. When the speech recognition unit 1*b* has detected a request for a particular web page, the web page data collector 1*c* makes access to the requested page to obtain its web page data. The keyword extractor 1*d* extracts predetermined keywords from the obtained web page data, if any. The replacement unit 1*e* locates a character string associated with each keyword extracted by the keyword extractor 1*d*, and replaces it with another character string. The vocalizer 1*f* performs a text-to-speech conversion for all or part of the resultant text that the replacement unit 1*e* has produced.

The above data processing system 1 operates as follows. Suppose that the user has lifted his handset off the hook, which makes the telephone set 3 initiate a call to the data processing system 1 by dialing its preassigned phone number. This call signal is delivered to the data processing system 1 over the PSTN 2 and accepted at the call reception unit 1*a*. The telephone set 3 and data processing system 1 then set up a circuit connection between them, thereby starting a communication session.

Now that the communication channel has been established, the telephone user issues a voice command, such as "Connect me to the homepage of ABC Corporation." The PSTN 2 transports this voice signal to the speech recognition unit 1*b* in the data processing system 1. With an appropriate voice recognition algorithm, the speech recognition unit 1*b* identifies the user's verbal message as a command that requests the system 1 to make access to the homepage of ABC Corporation. Then the call reception unit 1*a* so notifies the web page data collector 1*c*.

In response to the user's command, the web page data collector 1*c* fetches web page data from the web site of ABC Corporation, which is located on the server 5. The web page data containing, for example, an HTML-coded document is transferred over the Internet 4. The web page data collector 1*c* supplies the data to the keyword extractor 1*d*, which then scans through the given text to find out whether any predetermined keywords are included. Those keywords are used to identify for what genre the obtained web page document is intended. Such keywords may include: "baseball," "records," "impressionists," and "computer." Consider, for example, that the keyword extractor 1*d* has found a keyword "computer" in the homepage of ABC Corporation. This means that the web page relates to computers.

The document text may contain some particular character strings which should be pronounced differently, or would better be paraphrased into other expressions, depending on their relevant categories or genres. If any such character string is found, the replacement unit 1*e* substitutes another appropriate character string for that string. Since the subject matter is "computer" in the present example, the character string "ROM" (i.e., read only memory) is supposed to be pronounced as a single word "rom." In the computer context, it is not correct to read it out as a sequence of individual alphabets "R-O-M." Accordingly, the replacement unit 1*e* replaces every instance of "ROM" in the document with "rom" to prevent it from being vocalized incorrectly.

The text data modified by the replacement unit 1*e* is then passed to the vocalizer 1*f* for synthetic speech generation. The resultant voice signal is transmitted back to the telephone set 3 over the PSTN 2. Through the handset of the telephone set 3, the user hears a computer-generated speech which corresponds to the text data obtained from the homepage of the ABC Corporation. As mentioned above, the vocalizer 1*f* reads out the term "ROM" as "rom," instead of enunciating each character separately as "R-O-M." This feature of the proposed data processing system assures the user's comprehension of the web page content.

As described above, the proposed data processing system identifies the genre of a desired web page by examining the presence of some particular keywords in the downloaded text data. It then performs replacement of some character strings with appropriate alternatives, based on the identified genre of the document, so that the text will be converted into more comprehensible speech for the user.

Figure 2:
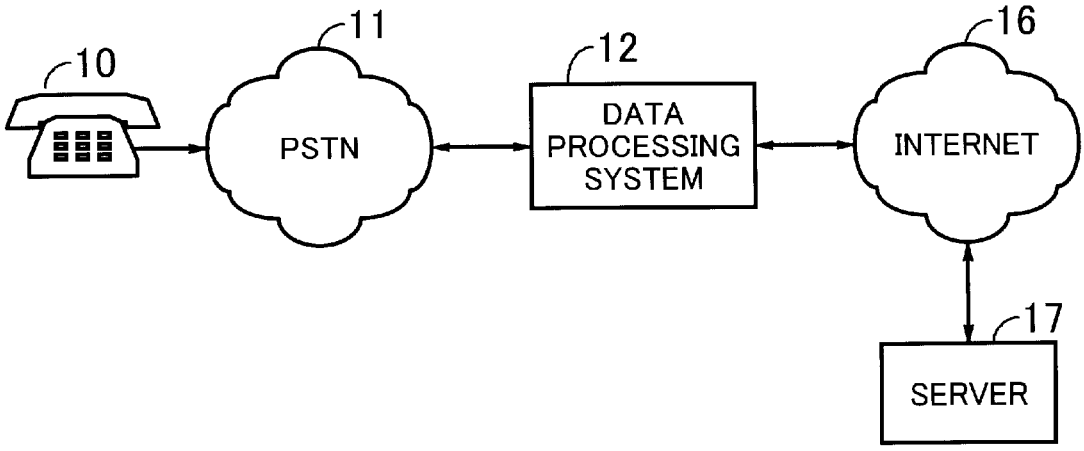
FIG. 2 shows a typical environment where the present invention is embodied.

A more specific embodiment of the present invention will now be described below with reference to FIGS. 2 and 3. First, FIG. 2 illustrates an environment where the present invention is embodied. At the user's end of this system, a telephone set 10 converts the user's speech into an electrical signal for transmission to a remote data processing system 12 over a PSTN 11. The telephone set 10 also receives a voice signal from the data processing system 12 and converts it back to an audible signal.

Upon receiving a call from the user via the PSTN 11, the data processing system 12 sets up a circuit connection with the calling telephone set 10. When a voice command is received, it downloads web page data from the desired web site maintained at the server 17. After manipulating the obtained data with predetermined rules, the data processing system 12 performs a text-to-speech conversion to send a voice signal back to the telephone set 10.

The Internet 16 works as a medium between the data processing system 12 and server 17, supporting the Hyper Text Transfer Protocol (HTTP), for example, to transport text, images, voice, and other types of information. The server 17 is a web server which stores web pages that are written in the HTML format. When a web access command is received from the data processing system 12, the server 17 provides the requested web page data to the requesting data processing system 12.

Figure 3:
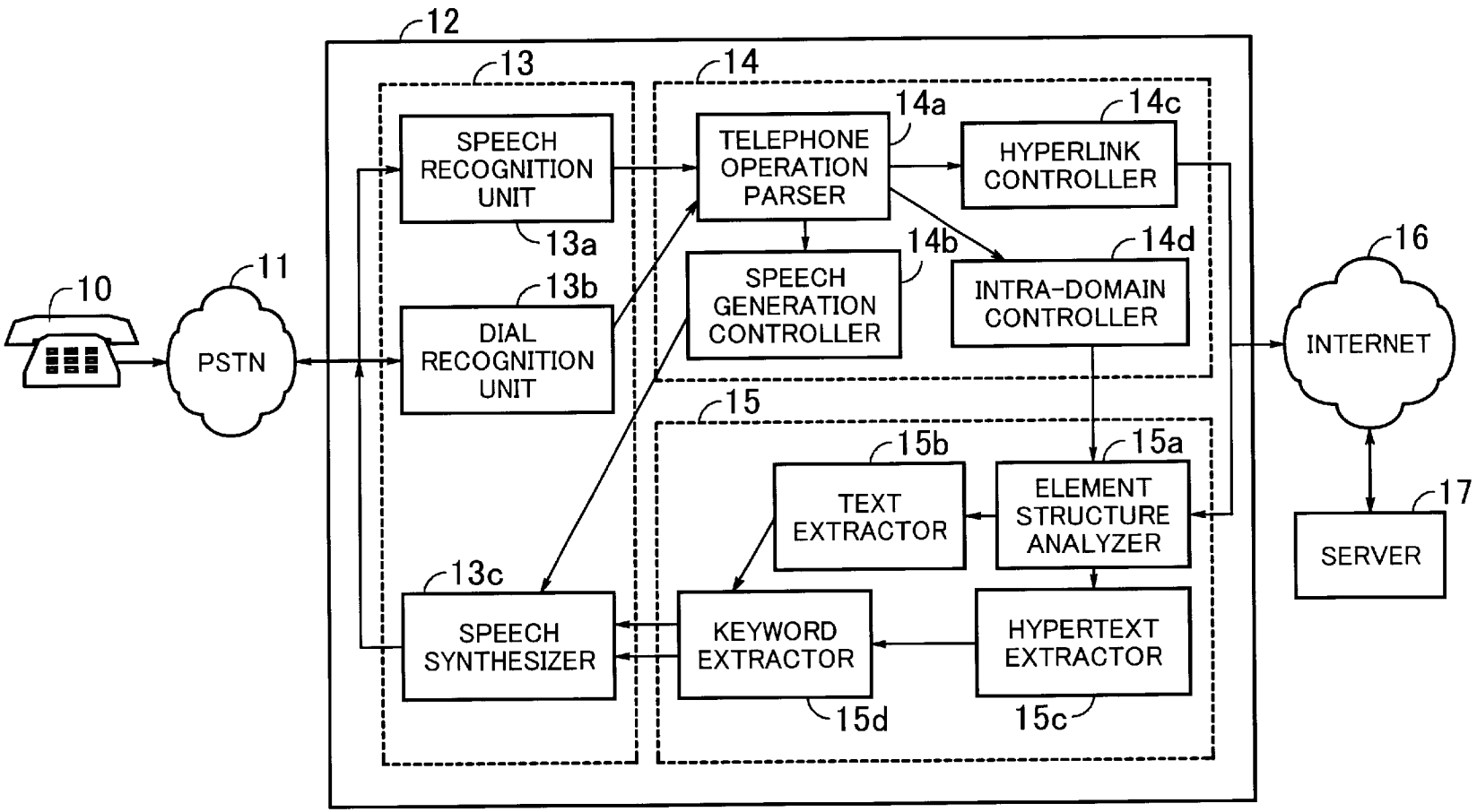
FIG. 3 is a detailed block diagram of a data processing system shown in FIG. 2, according to a first aspect of the present invention.

FIG. 3 is a detailed block diagram of the proposed data processing system 12 shown in FIG. 2. As seen from this diagram, the data processing system 12 is broadly divided into the following three parts: a voice response unit 13 which interacts with the telephone set 10; a browser unit 14 which downloads web page data from the server 17; and an HTML analyzer unit 15 which analyzes the downloaded web page data.

The voice response unit 13 comprises a speech recognition unit 13*a*, a dial recognition unit 13*b*, and a speech synthesizer 13*c*. The speech recognition unit 13*a* analyzes the voice signal sent from the telephone set 10 to recognize the user's message and notifies the telephone operation parser 14*a* of the result. The dial recognition unit 13*b* monitors the user's dial operation. When it detects a particular sequence of dial tones or pulses, the dial recognition unit 13*b* notifies the telephone operation parser 14*a* of the detected sequence. The speech synthesizer 13*c* receives text data from the keyword extractor 15*d*. Under the control of the speech generation controller 14*b*, the speech synthesizer 13*c* converts this text data into a speech signal for delivery to the telephone set 10 over the PSTN 11.

While some elements have already been mentioned above, the browser unit 14 comprises a telephone operation parser 14*a*, a speech generation controller 14*b*, a hyperlink controller 14*c*, and an intra-domain controller 14*d*. The telephone operation parser 14*a* analyzes a specific voice command or dial operation made by the user. The result of this analysis is sent to the speech generation controller 14*b*, hyperlink controller 14*c*, and intra-domain controller 14*d*. The speech generation controller 14*b* controls synthetic speech generation which is performed by the speech synthesizer 13*c*. The hyperlink controller 14*c* requests the server 17 to send the data of a desired web page. The intra-domain controller 14*d* controls the movement of a pointer within the same site (i.e., within a domain that is addressed by a specific URL). The movement may be made from one line to the next line, or from one paragraph to another.

The HTML analyzer unit 15 comprises an element structure analyzer 15*a*, a text extractor 15*b*, a hypertext extractor 15*c*, and a keyword extractor 15*d*. The element structure analyzer 15*a* analyzes the structure of HTML elements that constitute a given web page. The text extractor 15*b* extracts the text part of given web page data, based on the result of the analysis that has been performed by the element structure analyzer 15*a*. According to the same analysis result, the hypertext extractor 15*c* extracts hypertext tags from the web page data. Particularly, such hypertext tags include hyperlinks which define links to other data. The keyword extractor 15*d* extracts predetermined keywords from the text part or hypertext tags for delivery to the speech synthesizer 13*c*.

Figure 4:
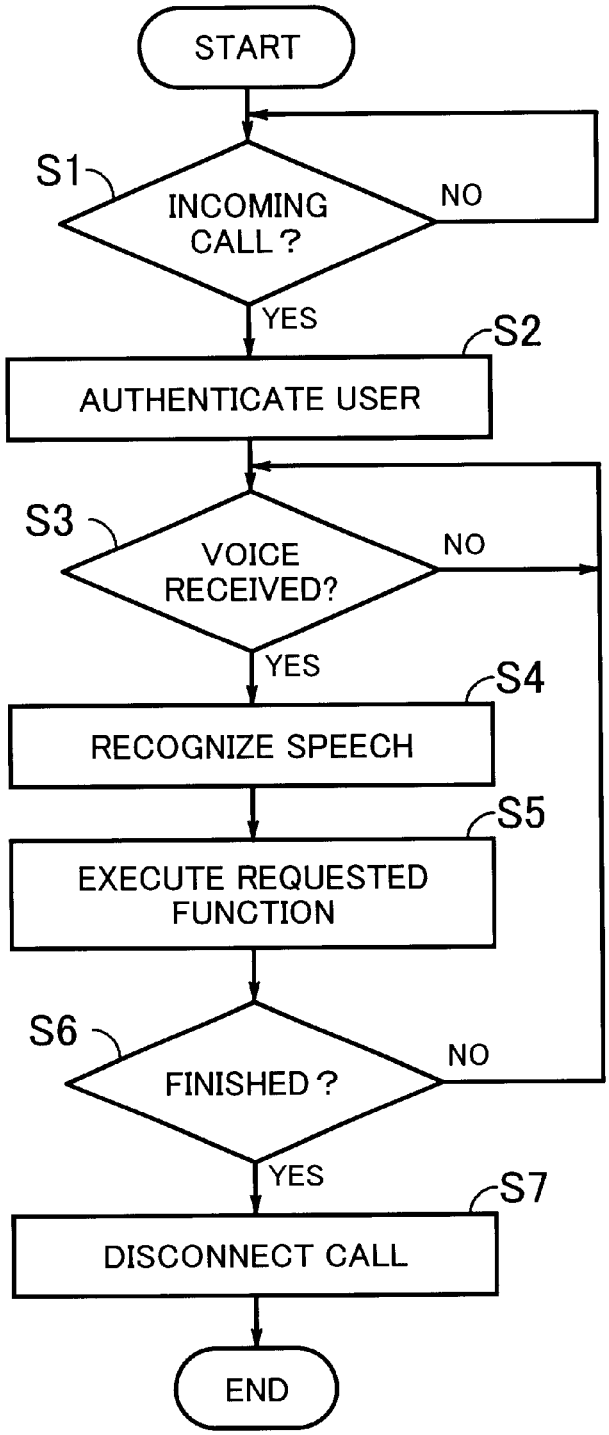
FIG. 4 is a flowchart which explains how a call is processed in the embodiment shown in FIG. 3.

The operation of the present embodiment of the invention will now be described below. FIG. 4 is a flowchart which explains how the data processing system 12 accepts and processes a call from the telephone set 10. The process, including establishment and termination of a circuit connection, comprises the following steps.

(S1) When a call is received from a user, the data processing system 12 advances its process step to S2. Otherwise, the process repeats this step S1 until a call arrives.

(S2) The user enters his/her password by operating the dial buttons or rotary dial of the telephone set 10. With this password, the telephone operation parser 14*a* authenticates the requesting user's identity. Since the user authentication process, however, is optional, the step S2 may be skipped.

(S3) The speech recognition unit 13*a* determines whether any verbal message is received from the user. If any message is received, the process advances to step S4. If not, this step S3 is repeated until any message is received.

(S4) The speech recognition unit 13*a* analyzes and recognizes the received verbal message.

(S5) The browser unit 14 performs the user's intended operation if it is recognized at step S4. More specifically, the user may request the system to connect himself/herself to a certain web page. If this is the case, the hyperlink controller 14*c* visits the specified web site and downloads that page.

(S6) The data processing system 12 determines whether the current communication session is ending. If so, the process advances to step S7. If not, the process returns to step S3 and repeats the command processing described above.

Suppose, for example, that the user has put down the handset. This user action signals the data processing system 12 that the circuit connection has to be disconnected because the call is finished. The data processing system 12 then proceeds to step S7, accordingly.

(S7) The data processing system 12 disconnects the circuit connection that has been used to interact with the telephone set 10.

The above processing steps allow the user to send a command to the data processing system 12 by simply uttering it or by operating the dial of his/her telephone set 10. The data processing system 12 then executes requested functions according to the command.

Figure 5:
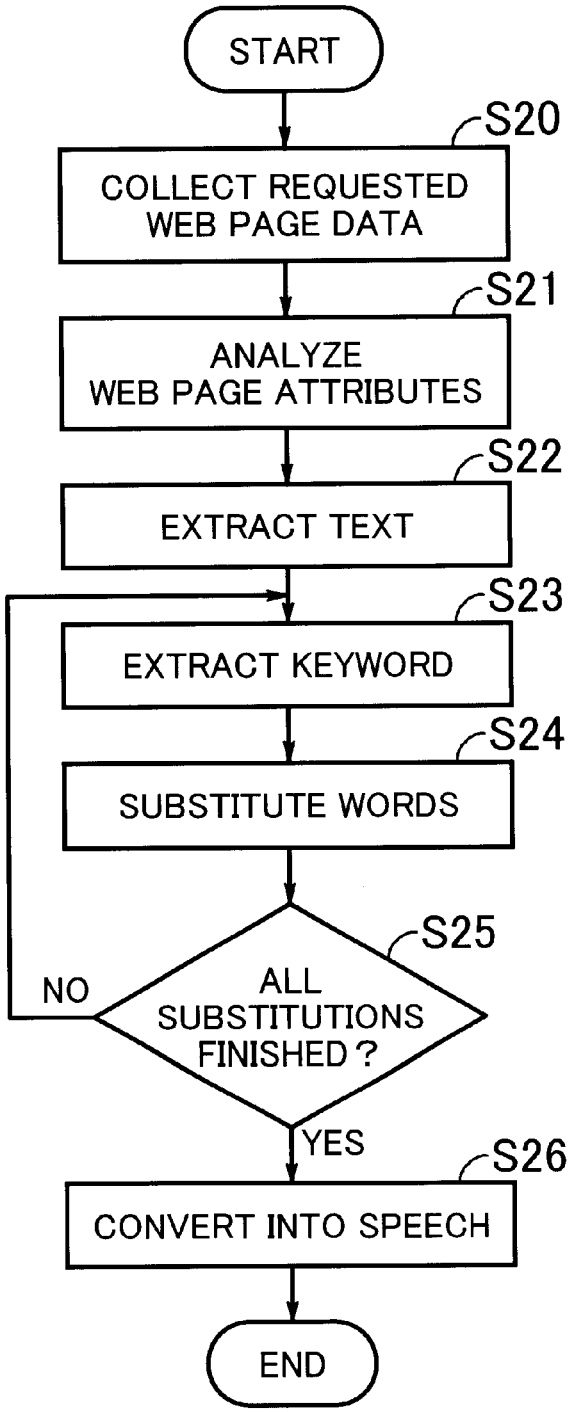
FIG. 5 is a flowchart which explains a typical process of character string translation.

When requested, the proposed data processing system 12 makes access to a web page and downloads its document data. It then presents the downloaded document to the requesting user after replacing some of the character strings contained in the document text with more appropriate ones, depending on which genre the document falls into. FIG. 5 is a flowchart showing the details of this processing, which comprises the following steps.

(S20) When a vocal command for a particular web page is received from the user, the hyperlink controller 14*c* makes access to the requested page to collect its web page data. Suppose, for example, that it has obtained a web page shown in FIG. 6.

(S21) The element structure analyzer 15*a* analyzes the obtained web page data to identify its attributes.

Figure 6:
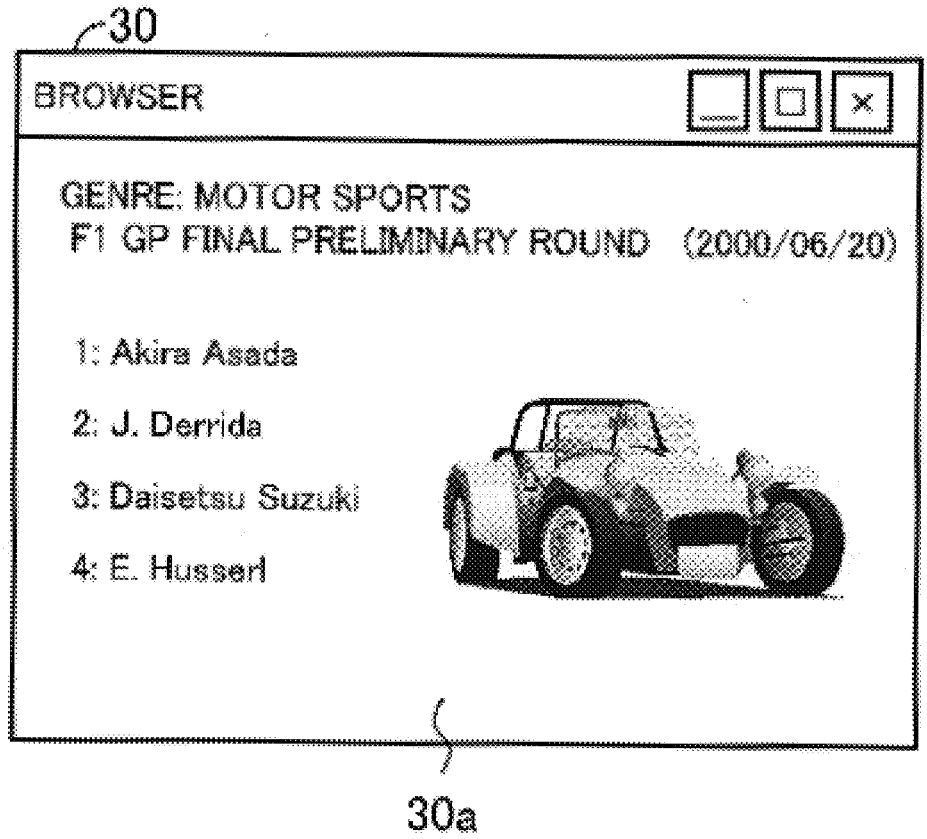
FIG. 6 shows an example of a web page to be subjected to the processing of FIG. 5.

The example web page of FIG. 6 contains text information "Genre: Motor Sports . . . " and a graphic image of an automobile, which are displayed within the pane 30*a* of the window 30. The element structure analyzer 15*a* finds these things as the attributes that characterize the web page.

(S22) Based on the analysis made by the element structure analyzer 15*a*, the text extractor 15*b* extracts relevant text data from the web page data. In the present example (FIG. 6), it extracts a string "Genre: Motor Sports . . . ."

(S23) The keyword extractor 15*d* scans the web page data to extract predefined keywords. Specific examples of such keywords are shown in the columns titled "Keyword #1" to "Keyword #4" in a character string translation table of FIG. 7. The first column of this table shows a list of words that are to be replaced with substitutive expressions which are given in the next column. The subsequent four columns "Keyword #1" to "Keyword #4" contain the keywords that are used to identify the genre of a given web page document.

In the present example (FIG. 6), the text data contains a keyword "motor sports." This keyword makes the keyword extractor 15*d* choose the second and third entries of the table.

(S24) Using the keyword(s) supplied from the keyword extractor 15*d*, the speech synthesizer 13*c* consults the word substitution table of FIG. 7 to find a table entry that matches with the keyword(s). If such a table entry is found, it then extracts a pair of words in the left-most two columns of that entry, and replaces every instance of the first-column word in the text data with the second-column word.

In the present example (FIG. 6), the words "F1" and "GP" in the text data are replaced with "formula one" and "grand prix," respectively.

(S25) The speech synthesizer 13*c* determines whether all necessary word substitutions have been applied. If so, the process advances to step S26. If not, the process returns to step S23 to repeat the above steps.

(S26) The speech synthesizer 13*c* performs a text-to-speech conversion to vocalize the modified text data, and the resultant voice signal is sent out to the telephone set 10. In the present example (FIG. 6), the original text "F1 GP Final Preliminary Round" is converted into a speech "formula one grand prix final preliminary round."

While not mentioned in the above explanation, the example web page of FIG. 6 includes a date code "2000/6/20" subsequent to the header text "F1 GP Final Preliminary Round." Such a date specification may also be subjected to the character string translation processing described above. More specifically, the proposed data processing system 12 divides the date code into three parts being separated by the delimiter "/" (slash mark). The system 12 then interprets the first 4-digit figure as the year, the second part as the month, and the third part as the day. Accordingly, the speech synthesizer 13*c* vocalizes the original text "2000/6/20" as "June the twentieth in two thousand."

Similar types of paraphrasing will work effectively in many other instances. Consider, for example, that a character string "⅓" is placed alone at the bottom of a web page. While it may denote a fraction "one third" in other situations, the term "⅓" should be interpreted as "the first page out of three" in that particular context.

Although the above-described embodiment first identifies the genre of a given document by using predefined keywords, the sequence of these processing steps may be slightly modified. That is, the data processing system may first determines whether the document contains any word that would be replaced with another one, and if such a word is found, then it searches for a keyword associated with that string, so as to ensure that the document is of a relevant category. While the table shown in FIG. 7 contains up to four such keywords for each word pair, it is not intended to limit the invention to this specific number of keywords.

According to a second aspect of the present invention, the data processing system vocalizes hyperlinks placed on a web page. This feature will now be discussed in detail below with reference to FIGS. 8 and 9, assuming the same system environment as described in FIGS. 2 and 3.

Figure 8:
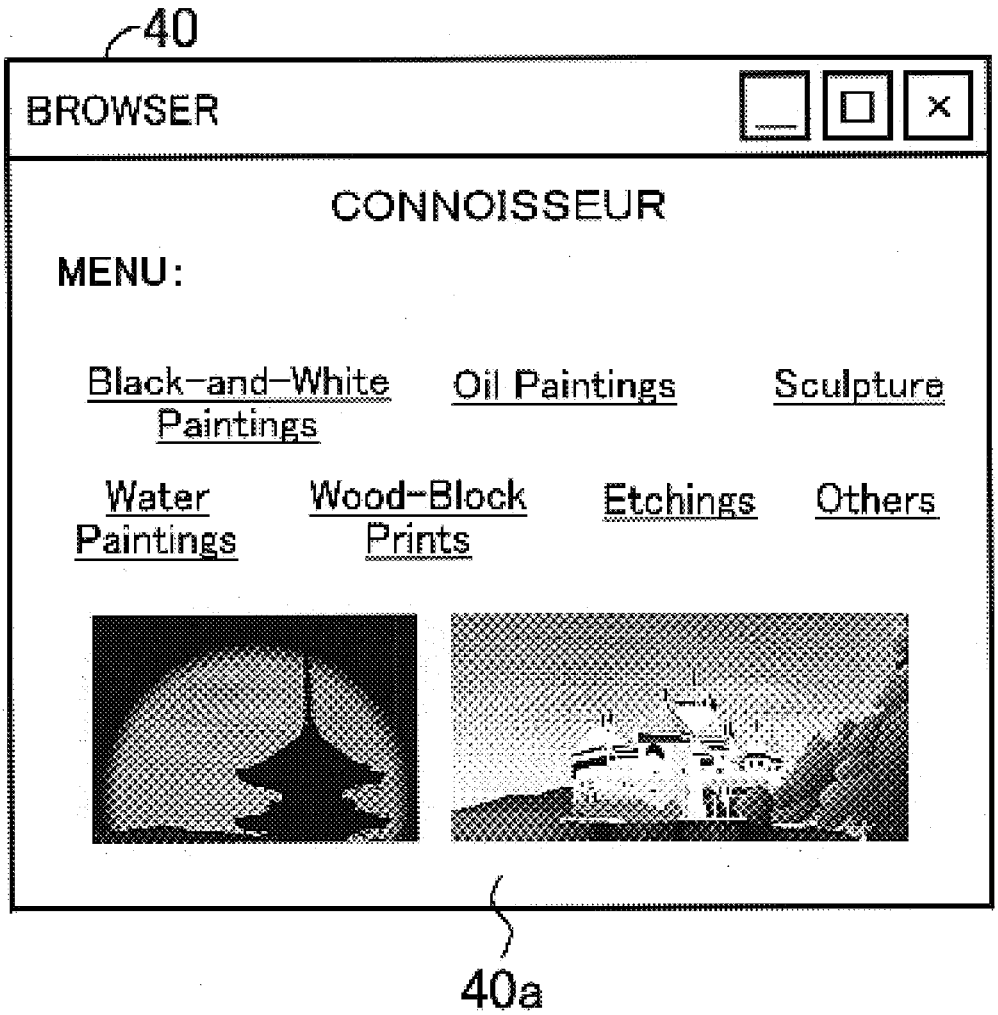
FIG. 8 shows an example of a web page which includes hyperlinks.

As an example of vocalization of hyperlinks, consider here that the proposed data processing system is attempting to process a web page shown in FIG. 8. This web page contains a list of hyperlinks under the title of "Menu," arranged within the pane 40*a* of the window 40. The menu actually includes the following items: "Black-and-White Paintings," "Oil Paintings," "Sculpture," "Water Paintings," "Wood-Block Prints," "Etchings," and "Others." If these hyperlinks were simply converted into speech, the result would only be an incomprehensible sequence of words like "menu black and white paintings oil paintings sculpture . . . "; no one would be able to understand that they are selectable items of a menu.

The present invention solves the above problem by handling such hyperlinks as a single group and adding an appropriate announcement such as "The following is a list of menu items, providing you with seven options." After giving such an advanced notice to the listener, the system reads out the list of menu items. In this way, the present invention provides a user-friendly web browsing environment.

Figure 9:
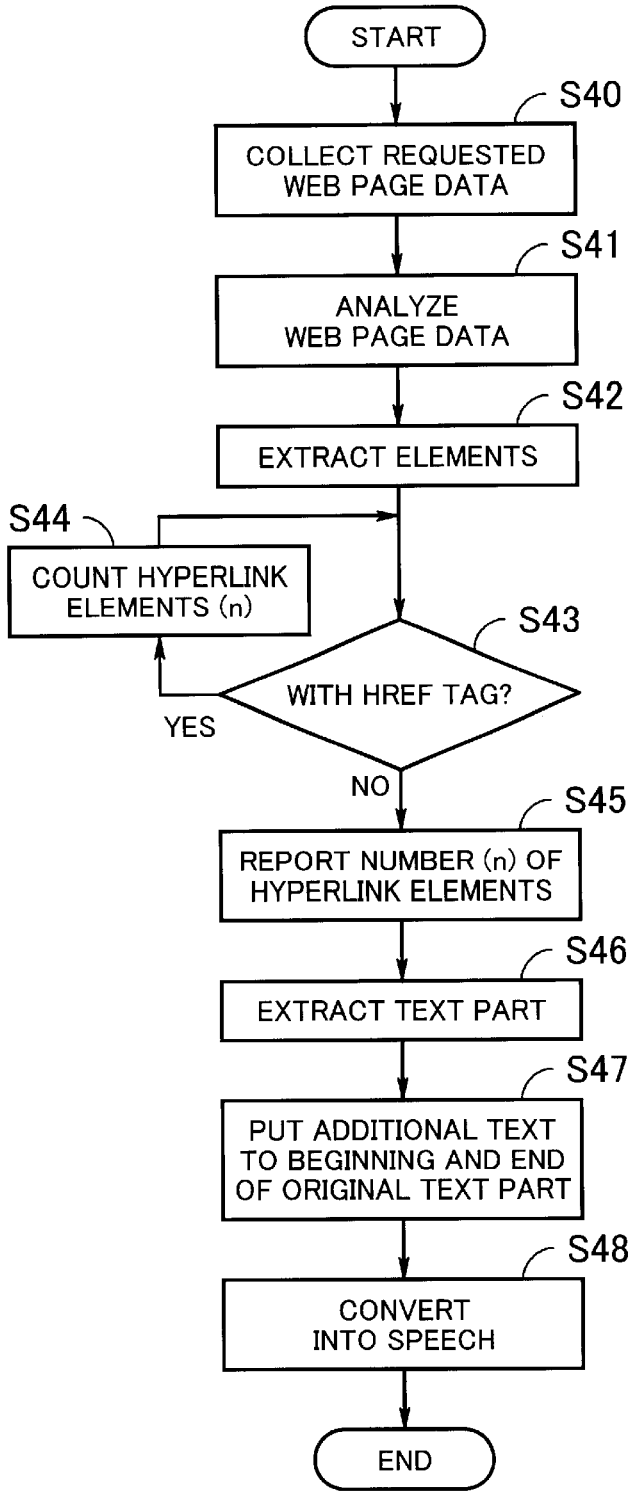
FIG. 9 is a flowchart of an example process which extracts hyperlink tags as a group of character strings, inserts supplementary statements at its beginning and ending portions, and vocalizes the resultant text.

FIG. 9 is a flowchart of an example process that enables the above feature of the invention, which comprises the following steps.

(S40) When a vocal command requesting a particular web page is received from the user, the hyperlink controller 14*c* makes access to the requested page to collect its web page data.

(S41) The element structure analyzer 15*a* analyzes the web page data downloaded from the server 17 at step S40, thereby identifying container elements that constitute the page of interest. The term "container element" refers to an HTML element that starts with an opening tag and ends with a closing tag.

(S42) The element structure analyzer 15*a* extracts the identified elements.

(S43) The element structure analyzer 15*a* examines each extracted element has a hyper reference (HREF) attribute. If so, the process advances to step S44. If not, the process proceeds to step S45.

(S44) The element structure analyzer 15*a* counts the elements with an HREF attribute and returns to step S43 for testing the next element. Since, in the present example (FIG. 8), the web page contains seven hyperlinks (e.g., "Black-and White Paintings" and the like), the counter value (n) will increase up to seven.

(S45) Via the text extractor 15*b*, the element structure analyzer 15*a* notifies the speech synthesizer 13*c* of the number (n) of hypertext elements.

(S46) The element structure analyzer 15*a* extracts the text part of each hyperlink element. In the present example (FIG. 8), the element structure analyzer 15*a* obtains seven text items "Black-and-White Paintings," "Oil Paintings," and so on.

(S47) The element structure analyzer 15*a* inserts some supplementary text at the beginning and end of the extracted text part.

In the present example (FIG. 8), the first hyperlink text "Black-and-White Paintings" is preceded by an announcement such as "The following is a list of menu items, providing you with seven options." In addition, the last hyperlink text "Others" is followed by a question such as "That concludes the menu. Which item is your choice?"

(S48) The speech synthesizer 13*c* performs a text-to-speech conversion to vocalize the extracted text part, together with the supplementary text. In the present example (FIG. 8), the speech synthesizer 13*c* generates a verbal announcement: "The following is a list of menu items, providing you with seven options to choose. 'Black-and-White Paintings,' 'Oil Paintings,' . . . and 'Others.' That concludes the menu. Which item is your choice?"

As seen from the above description of the embodiment, a plurality of hyperlink elements are handled as a single group, and that group is added a preceding and following statements that give some supplementary information to the user. This mechanism enables more comprehensible representation of a list of words, such as menu items.

According to a third aspect of the present invention, the data processing system vocalizes entries of a table. This feature will now be discussed in detail below with reference to FIGS. 10 to 12, assuming the same system environment as described in FIGS. 2 and 3.

Figure 10:
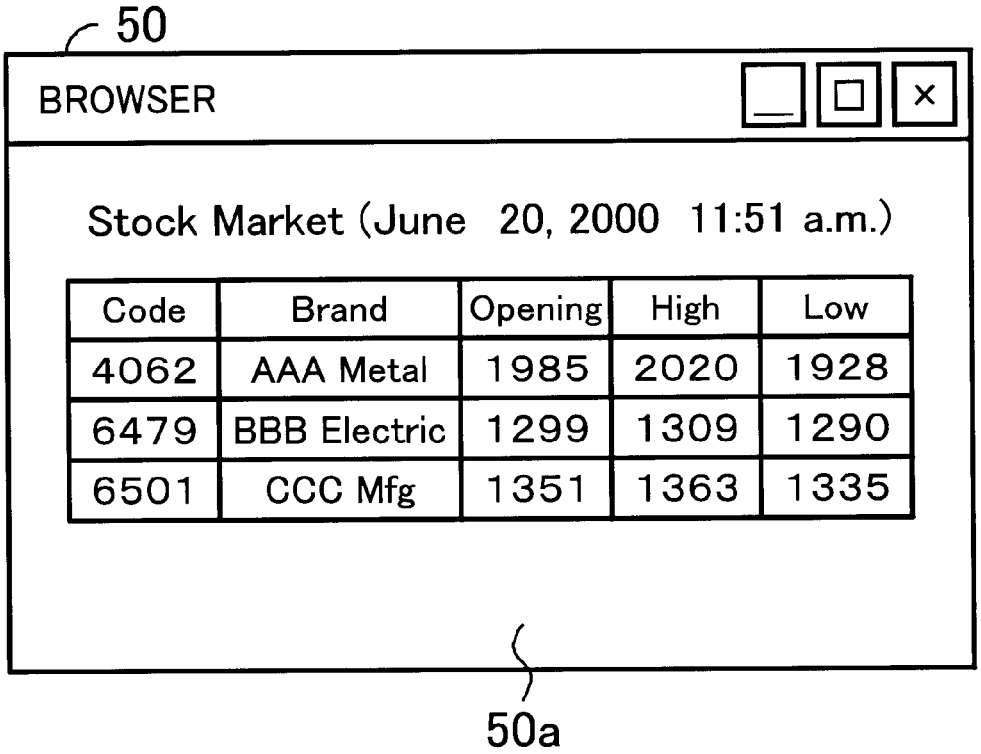
FIG. 10 shows an example of a web page including a table.
Figure 11:
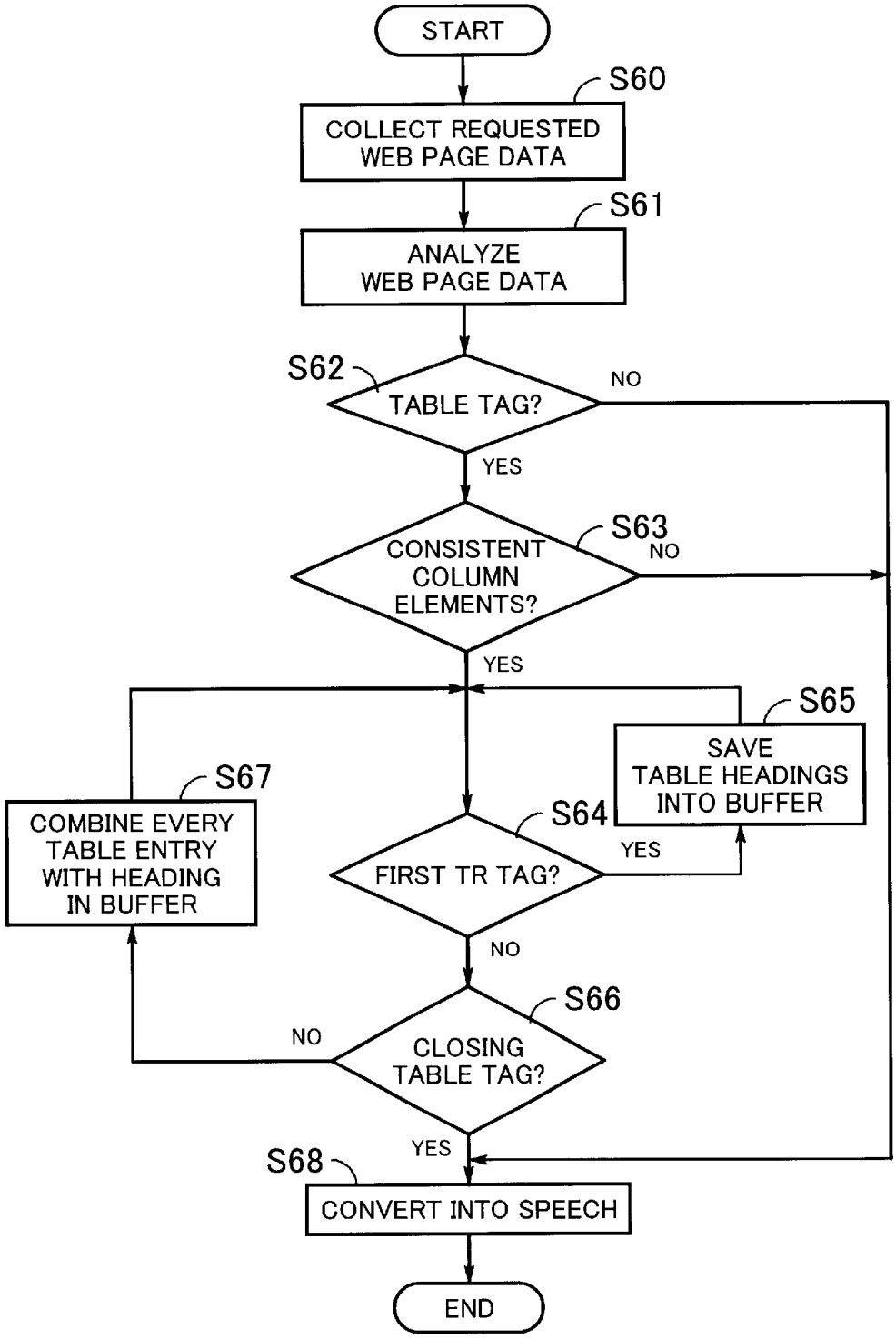
FIG. 11 is a flowchart of a process which vocalizes table cells, together with their headings.

As an example of vocalization of a table, consider here that the proposed data processing system is attempting to vocalize a web page shown in FIG. 10. This web page provides current stock market conditions in table form, arranged within the pane 50*a* of the window 50. When converted into speech, this table would start with a list of column headings "Code," "Brand," "Opening," "High," and "Low," which would then be followed by the values of items, from left to right, or from top to bottom. This simple vocalization, however, is not so usable because it is difficult for the listener to understand the relationship between each table cell and its heading label. According to the third aspect of the present invention, the above problem will be solved by inserting a corresponding heading before reading each table cell aloud. FIG. 11 is a flowchart of an example process that enables this feature of the present invention.

(S60) When a vocal command requesting a particular web page is received from the user, the hyperlink controller 14*c* makes access to the requested page to collect its web page data.

(S61) The element structure analyzer 15*a* analyzes the web page data downloaded form the server 17 at step S60, thereby identifying container elements that constitute the page.

(S62) The element structure analyzer 15*a* determines whether the identified element contains a "table" tag (<TABLE>). If so, the process advances to step S63. If not, the process skips to step S68.

(S63) Scanning the table found at step S62, the element structure analyzer 15*a* determines whether each column is consistent in terms of content types. If so, the process advances to step S64. If not, the process proceeds to step S68.

The consistency within a column is checked by examining which type of characters (e.g., alphabets, numerals, Kanji, Kana) constitute each table cell, or by evaluating the similarity among the table cells in terms of data length. The proposed system is designed to carry out such consistency check to avoid any table cells from being called falsely.

(S64) The element structure analyzer 15*a* finds the first instance of "table row" tag (<tr>) within the table definition. If it is found, the process advances to step S65. If not, the process proceeds to step S66.

FIG. 12 shows an example of an HTML document representing the web page of FIG. 10. As seen in the top part of this document, the table headings are defined in the uppermost table-row container element that begins with a <tr> tag and ends with a </tr> tag. The element structure analyzer 15*a* detects this first <tr> tag and proceeds to step S65 accordingly.

(S65) Now that the table header is located, the element structure analyzer 15*a* saves the table headings into buffer storage and then returns to step S64. In the present example (FIG. 10), this step S65 yields five table labels "Code," "Brand," and so on.

(S66) The element structure analyzer 15*a* determines whether it has reached the closing table tag. In the present example (FIG. 12), the table definition starts with a <table> tag and ends with a </table> tag. When the closing tag </table> is encountered, the element structure analyzer 15*a* recognizes it as the end of the table, and then it proceeds to step S68. Otherwise, it proceeds to step S67.

(S67) The element structure analyzer 15*a* combines the text of each table cell with its corresponding heading label. Take a table cell "4062" in the first column of the table of FIG. 10, for example. This cell value will be combined with its heading label "Code," thus yielding "Code 4062."

(S68) The speech synthesizer 13*c* performs a text-to-speech conversion for the combined text. In the present example (FIG. 10), the first row of the table, for example, is vocalized as "Code '4062,' Brand 'AAA Metal,' Opening '1985,' High '2020,' Low '1928.'"

As described above, the proposed system inserts a corresponding heading before reading each table cell aloud, when it vocalizes a web page containing a table. This feature of the present invention helps the user understand the contents of a table. Although the above description has assumed that the table heading is assigned to each column, those skilled in the art will appreciate that the same concept of the invention can apply to the cases where a heading label is provided for each row of the table in question. In the case the table has the headings in both columns and rows, the system will read out the column label first, then row label, and lastly, the table cell content. Or it may begin with the row label, and then read out the column label and table cell.

The proposed processing mechanisms are actually implemented as software functions of a computer system. The process steps of the proposed data processing system are encoded in a computer program, which will be stored in a computer-readable storage medium. The computer system executes this program to provide the intended functions of the present invention. Suitable computer-readable storage media include magnetic storage media and solid state memory devices. Other portable storage media, such as CD-ROMs and floppy disks, are particularly suitable for circulation purposes. Further, it will be possible to distribute the programs through an appropriate server computer deployed on a network. The program file delivered to a user is normally installed in his/her computer's hard drive or other local mass storage devices, which will be executed after being loaded to the main memory.

The above discussion is summarized as follows. According to the present invention, the proposed data processing system identifies the genre of a desired web page by examining the presence of some particular keywords in the downloaded text data. It then performs replacement of some particular character strings with appropriate alternatives, based on the identified genre. The resultant text will be converted into more comprehensible speech for the user.

Further, according to the present invention, a plurality of hyperlink elements are handled as a single group, and that group is supplemented by a preceding and following statements that give some helpful information to the user. This mechanism enables more comprehensible representation of a list of words, such as menu items.

Moreover, the proposed data processing system vocalizes a table contained in a web page, inserting a corresponding heading before reading each table cell aloud. This feature of the present invention helps the user understand the contents of the table.

The foregoing is considered as illustrative only of the principles of the present invention. Further, since numerous modifications and changes will readily occur to those skilled in the art, it is not desired to limit the invention to the exact construction and applications shown and described, and accordingly, all suitable modifications and equivalents may be regarded as falling within the scope of the invention in the appended claims and their equivalents.

What is claimed is:

1. A data processing system which provides a user with vocalized information of web pages that are written in a markup language, comprising:

call reception means for accepting a call from a telephone set used by the user;

speech recognition means for recognizing a verbal message being received from the telephone set used by the user;

web page data collection means, responsive to a request for a particular web page which is recognized by said speech recognition means, for making access to the requested web page to obtain web page data therefrom;

keyword extraction means for extracting a predetermined keyword from the web page data;

addition means for locating a character string associated with the keyword extracted by said keyword extraction means, and modifying text of the web page data by putting an additional character string by the located character string; and vocalizing means for vocalizing at least a part of the resultant text that has been modified by said addition means.

2. A computer-readable medium storing a program which provides a user with vocalized information of web pages that are written in a markup language, the program causing a computer system to function as:

call reception means for accepting a call from a telephone set used by the user;

speech recognition means for recognizing a verbal message being received from the telephone set used by the user;

web page data collection means, responsive to a request for a particular web page which is recognized by said speech recognition means, for making access to the requested web page to obtain web page data therefrom;

keyword extraction means for extracting a predetermined keyword from the web page data;

addition means for locating a character string associated with the keyword extracted by said keyword extraction means, and modifying text of the web page data by putting an additional character string by the located character string; and vocalizing means for vocalizing at least a part of the resultant text that has been modified by said addition means.

3. A data processing system which provides a user with vocalized information of web pages that are written in a markup language, comprising:

call reception means for accepting a call from a telephone set used by the user;

speech recognition means for recognizing a verbal message being received from the telephone set used by the user;

web page data collection means, responsive to a request for a particular web page which is recognized by said speech recognition means, for making access to the requested web page to obtain web page data therefrom;

character string extraction means for extracting, from the obtained web page data, a group of character strings that have a semantical relationship;

addition means for inserting an additional character string by at least one of a beginning and an end of the group of character strings; and vocalizing means for vocalizing the group of character strings with the additional character string.

4. The data processing system according to claim 3, wherein said character string extraction means extracts a group of hyperlinks found in the web page data.

5. The data processing system according to claim 3, wherein:

said group of character strings are character strings contained in a table; and said addition means inserts a heading of each table cell at the beginning or end of a character string contained in the table cell.

6. A computer-readable medium storing a program which provides a user with vocalized information of web pages that are written in a markup language, the program causing a computer system to function as:

call reception means for accepting a call from a telephone set used by the user;

speech recognition means for recognizing a verbal message being received from the telephone set used by the user;

web page data collection means, responsive to a request for a particular web page which is recognized by said speech recognition means, for making access to the requested web page to obtain web page data therefrom;

character string extraction means for extracting, from the obtained web page data, a group of character strings that have a semantical relationship;

addition means for inserting an additional character string by at least one of a beginning and an end of the group of character strings; and vocalizing means for vocalizing the group of character strings with the additional character string.

7. A data processing system which provides a user with vocalized information of web pages that are written in a markup language, comprising:

a voice response unit which accepts a call from the a telephone set used by the user and recognizes a verbal message received from the telephone set used by the user;

a browser which obtains web page data from a requested web page responsive to a request for the web page recognized by the voice response unit;

an HTML analyzer which extracts a keyword from the web page data; and a speech synthesizer which locates a character string associated with the keyword extracted by the HTML analyzer, and which modifies text of the web page data by adding an additional character string next to the located character string, wherein the speech synthesizer vocalizes at least a part of the text that modified by the speech synthesizer.

8. A data processing system which provides a user with vocalized information of web pages that are written in a markup language, comprising:

a voice response unit which accepts a call from the a telephone set used by the user and recognizes a verbal message received from the telephone set used by the user;

a browser which obtains web page data from a requested web page responsive to a request for the web page recognized by the voice response unit;

an HTML analyzer which extracts a group of character strings having a semantical relationship from the obtained web page data; and a speech synthesizer which inserts an additional character string to at least one of a beginning and an end of the group of character strings, wherein the speech synthesizer vocalizes the group of character strings with the additional character string.

9. A data processing method for providing a user with vocalized information of web pages that are written in a markup language, comprising:

accepting a call from the a telephone set used by the user;

recognizing a verbal message received from the telephone set used by the user;

obtaining web page data from a requested web page responsive to a request for the web page which is recognized by the recognizing;

extracting a keyword from the web page data;

locating a character string associated with the extracted keyword;

modifying text of the web page data by putting an additional character string by the located character string; and vocalizing at least a part of the modified text.

10. A data processing method for providing a user with vocalized information of web pages that are written in a markup language, comprising:

accepting a call from the a telephone set used by the user;

recognizing a verbal message received from the telephone set used by the user;

obtaining web page data from a requested web page responsive to a request for the web page which is recognized by the recognizing;

extracting a group of character strings that have a semantical relationship from the obtained web page data;

inserting an additional character string to at least one of a beginning and an end of the group of character strings; and vocalizing the group of character strings with the additional character string.

* * * * *